US008230947B2

(12) United States Patent
Warren

(10) Patent No.: US 8,230,947 B2
(45) Date of Patent: Jul. 31, 2012

(54) METHOD OF SELECTING A DRILLING MOTOR FOR A CASING DRILL STRING

(75) Inventor: Tommy M. Warren, Coweta, OK (US)

(73) Assignee: Tesco Corporation, Houston, TX (US)

( * ) Notice: Subject to any disclaimer, the term of this patent is extended or adjusted under 35 U.S.C. 154(b) by 665 days.

(21) Appl. No.: 12/399,568

(22) Filed: Mar. 6, 2009

(65) Prior Publication Data

US 2010/0224413 A1 Sep. 9, 2010

(51) Int. Cl.
*E21B 47/00* (2012.01)

(52) U.S. Cl. ..... 175/40; 175/57; 175/424; 166/104

(58) Field of Classification Search ..... 175/40, 175/57, 424; 166/104
See application file for complete search history.

(56) References Cited

U.S. PATENT DOCUMENTS 5,368,108 A * 11/1994 Aldred et al. ..... 175/40
5,679,894 A * 10/1997 Kruger et al. ..... 73/152.03

OTHER PUBLICATIONS

SPE/IADC SPE-119446-PP "High Angle Directional Drilling with 9-5/8 in. Casing in Offshore Qatar", Michael Avery (Occidental Petroleum of Qatar Ltd.), Tod Stephens (Occidental Petroleum of Qatar Ltd.), Mounir Turki (Tesco Corp.), Malek Abed (Schlumberger D&M), Copyright 2009, SPE/ADC Drilling Conference and Exhibition in Amsterdam, The Netherlands, Mar. 17-19, 2009.

* cited by examiner

*Primary Examiner* — William P Neuder
*Assistant Examiner* — Yong-Suk Ro
(74) *Attorney, Agent, or Firm* — Bracewell & Giuliani LLP

(57) ABSTRACT

A method for selecting a drilling motor for rotating a drill bit relative to a drill string made up of casing accounts for a tendency for the casing to elongate as the internal pressure increases. The increase in pressure in the casing string increases the weight on the drill bit, the amount of which may be calculated based on the size and type of the string of casing. The ratio of bit torque over the weight on the bit may be assumed to be a constant number based on empirical measurements or a theoretical model. The increase in the weight on the drill bit can be expressed in terms of the bit torque versus the casing pressure, which is a linear slope. This linear slope may be compared to the delivery torque of candidate motors.

15 Claims, 5 Drawing Sheets

Fig. 1
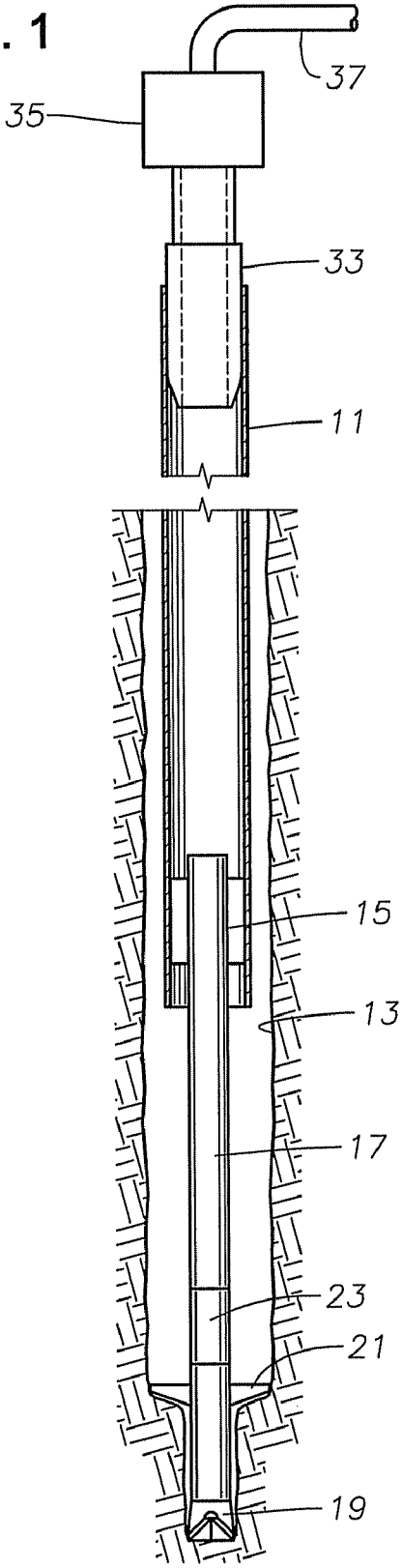
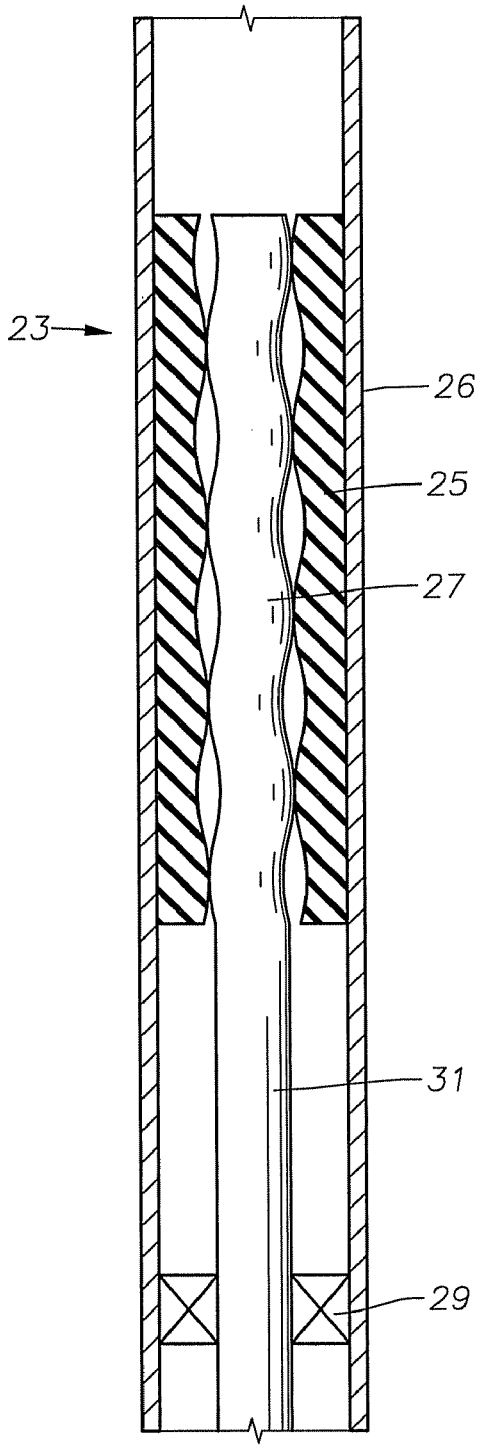
Fig. 2

WOB Increases as Internal Casing Pressure Increases $$\Delta WOB = \Delta P * [Ai - (2^{*Mu} * As / (OD/ID)^2 - 1)]$$

| | |
|---|---|
| ΔP | = change in casing pressure |
| ΔWOB | = change in weight-on-bit |
| Ai | = area of casing ID |
| As | = cross-sectional area of steel |
| OD | = casing outside diameter |
| ID | = casing inside diameter |
| Mu | = Poisson's ratio |

*4-3/4" motors could typically be used with 3-1/2" drill pipe and 7" casing

METHOD OF SELECTING A DRILLING MOTOR FOR A CASING DRILL STRING

FIELD OF THE INVENTION

This invention relates in general to earth-boring drilling operations, in particular to a method of selecting a drill motor for a casing drill string.

BACKGROUND OF THE INVENTION

Most wells are drilled today utilizing a string of drill pipe. The drill pipe is made up of joints of pipe that are secured together by threads. The drill pipe is rotated either by a kelly bushing of the drilling rig or by a top drive of the drilling rig. Also, particularly in deviated wells, the operator may mount a drill or mud motor in the drill string just above the drill bit. The drill motor has a stator and a rotor, and drilling fluid pumped down the drill string causes the rotor to rotate the drill bit. While operating the drill motor, the operator may continue to rotate the drill string or may allow the drill string to remain stationary from time to time for steering the drill bit in a desired direction. At various depths and after the well is completed, the operator retrieves the drill string and runs casing into the well. The operator cements the casing in place.

Another type of drilling utilizes a casing string or a liner string as the drill string rather than a separate section of drill pipe. Casing and liner comprise pipes that are intended to be cemented in the wellbore to line the wellbore. A difference between casing and liner is that each string of casing installed will extend back to the wellhead; the upper end of a liner string normally extends up only a short distance past the lower end of the last string of casing installed in the wellbore. For the purposes herein, both casing and liner will be referred to as casing. Casing is larger in outer diameter and inner diameter than conventional drill pipe.

Typically, a bottom hole assembly latches to the lower end of the string of casing. When the casing has drilled to a desired depth, the operator may retrieve the bottom hole assembly from the casing and cement the string of casing in place. An operator may also utilize a drill motor mounted in the bottom hole assembly for rotating the drill bit relative to the bottom hole assembly and the string of casing.

Drill motors are used for a variety of reasons while drilling with casing. They may be used in a "steerable" configuration for drilling along a non-vertical trajectory. They may be used in a straight-hole configuration for minimizing casing wear or reducing casing vibrations by allowing the casing to be rotated at a slow speed while rotating the drilling assembly at a higher speed. Drill motors may also be used to improve the penetration rate by providing higher bit rotational speed than would otherwise be practical.

There are generally two types of drill motors, one being a positive displacement motor and the other a turbine. The positive displacement motor has an elastomeric stator with a central passage having a helical contour. A rotor, normally formed of metal, extends through the passage. The rotor has a helical contour containing a different number of lobes from the stator. The discussions herein deal only with the positive displacement motor and are not applicable to turbine drill motors.

Drill motors provide a linear output torque proportional to the pressure drop through the power section of the motor. The bit speed is typically proportional to the flow rate of drilling mud passing through the motor. However, there is a slight decrease in rotational speed as the drill motor is loaded at higher torques and drilling fluid bypasses between the rotor and stator. Drill motors can be designed to provide a wide range of performance characteristics by selecting the diameter of the power section, the power section lobe configuration, the number of stages and the pitch of the stages.

In general, the end user is faced with a choice of selecting the proper motor from a catalogue of many motors provided by a number of motor providers. These drill motors are usually described along with a power curve, which is a graph of the output torque versus the internal fluid pressure drop as the fluid passes through the motor. Two main parameters other than motor size are used to characterize a motor. One is the maximum torque that can be provided, and the other is the rotational speed, which may be defined in terms of rotations per gallon of fluid throughput. The end user first selects the group of motors defined by the appropriate, usually largest, diameter that will fit in the hole to be drilled. Next, the flow rate of the drilling fluid is selected to provide adequate transport of the cuttings back up the annulus around the drill pipe while allowing the pressure losses in the wellbore annulus to be limited for well control and bore hole stability. A group of motors is then identified that provides the appropriate rotational speed for the drilling tools that will be used in the well. Finally, a motor is selected from this group that has sufficient torque to turn the drilling tools at the maximum weight on the bit expected to be needed to drill the well.

When drilling with casing, the process of selecting a drill motor described above often does not lead the user to a selection that will power the drilling equipment effectively. The central bore of the casing drill string is much larger than the central bore or a drill pipe drill string, which includes drill pipe and drill collars. Selecting the drill motor as if one would select a drill motor for a drill pipe drill string can lead to motors that may do not drill efficiently.

SUMMARY OF THE INVENTION

In the method of this invention, the operator determines a delivery torque provided by a first candidate motor as a function of the pressure drop of drilling fluid flowing through the first candidate motor. The operator calculates a demand torque for the drill string based on the type of drill bit and the effect the pressure drop through the motor ("DP) has on the weight on the bit ("DWOB"). The operator compares the demand torque to the delivery torque and may choose the first candidate motor if the delivery torque exceeds the demand torque by a selected level.

In one embodiment, the demand torque is determined partly by empirical measurements based on the type of drill bit to be used. For example, if the bit is a fixed head bit as opposed to a rolling cone bit, it will require more torque than the rolling cone bit to turn. Alternately, the theoretical models can be employed to determine the relationship between bit torque and the weight on the bit. Normally, the relationship between the bit torque and the WOB is linear, thus the ratio of the two is a constant number. Also, the operator determines the increase in WOB as a function of the increase in pressure in the casing string. This function may be calculated based on the cross-sectional area of the casing and the type of material of the casing. The demand torque can be expressed as a function of the DP so that it can be compared to the delivery torque.

BRIEF DESCRIPTION OF THE DRAWINGS

FIG. 1 is a schematic view illustrating a casing drill string with a drill motor selected in accordance with this invention.

FIG. 2 is an enlarged schematic view of the drill motor employed with the casing string in FIG. 1.

DETAILED DESCRIPTION OF THE INVENTION

Figure 3:
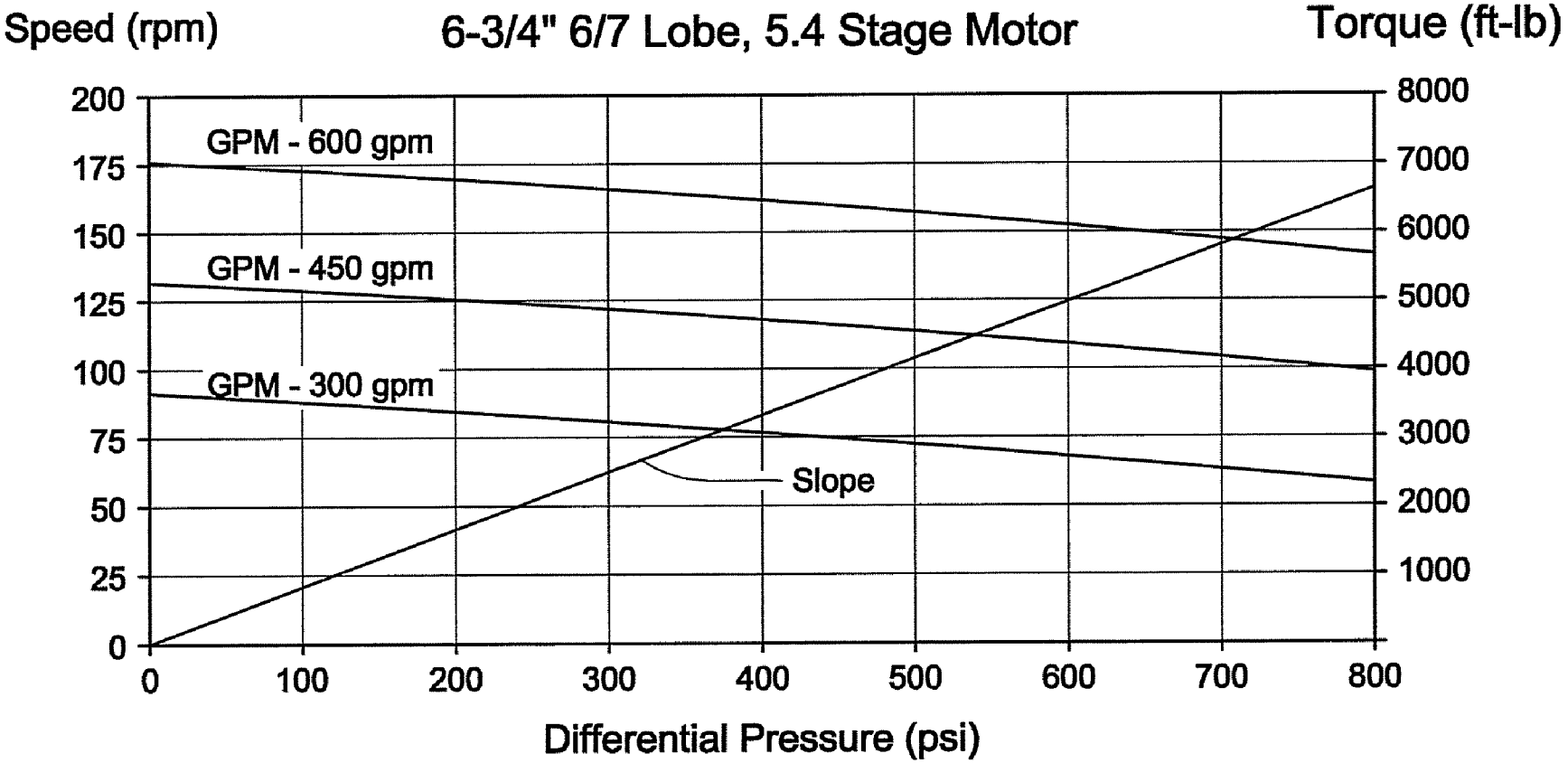
FIG. 3 is a performance curve of a typical drill motor, the performance curve being utilized to determine the delivery torque of the drill motor.

Referring to FIG. 1, a string of casing 11 is shown extending into a well 13 for drilling the well. Casing 11 is made up of conventional pipe used for casing or lining a wellbore. A drill latch or lock assembly 15 is located at the lower end of casing 11 in this example. Drill lock assembly 15 includes a profile nipple sub or latch collar that is connected by threads into the string of casing. Drill lock assembly 15 includes a tubular member connected to a bottom hole assembly 17. A drill bit 19 is located at the lower end of bottom hole assembly 17 for forming pilot hole in well 13. A reamer 21 is located above drill bit 19 for enlarging the bore of well 13 to a diameter greater than the outer diameter of casing 11. Reamer 21 is collapsible, enabling bottom hole assembly 17 to be retrieved up through casing 11 by unlatching drill lock assembly 15. Bottom hole assembly 17 may also include other tools such as well logging instruments and directional drilling or steering instruments and devices.

A drill or mud motor 23 is connected into bottom hole assembly 17 just above reamer 21 for rotating reamer 21 and drill bit 19 relative to casing 11. Reamer 21 rotates in unison with drill bit 19 and may be considered to be a part of drill bit 19. Drill motor 23 is a conventional device that causes rotation of drill bit 19 in response to drilling fluid pumped down through casing 11 and bottom hole assembly 17. A schematic example of a drill motor 23 is shown in FIG. 2. It will include a stator 25 that is normally elastomeric and bonded within a tubular housing 26. Housing 26 is secured by threads into bottom hole assembly 17. Stator 25 has an interior passage that is formed in a helical contour. A rotor 27, typically formed of metal, extends through the passage. Rotor 27 has a helical contour containing a different number of lobes from that of the stator 25. Drilling fluid pressure applied to the upper end of stator 25 flows into progressively forming cavities between rotor 27 and stator 25, causing rotor 27 to rotate. All of the drilling fluid being pumped down casing 11 flows through drill motor 23 and out nozzles of drill bit 19.

Rotor 27 has a lower end coupled by a flexible shaft 31 to drill bit 19. The lower end of flexible shaft 31 is concentrically supported by bearings 29. The upper end of shaft 31 orbits with rotor 27. Drill bit 19 may be a conventional type, such as a rolling cone bit or a PDC bit. A PDC bit is a solid head bit having polycrystalline diamond cutters that scrape against the formation as bit 19 is rotated.

Casing string 11 is supported and rotated by a gripping mechanism 33. Gripping mechanism 33 has grapples that insert into the upper end of casing string 11. The grapples are stroked hydraulically into gripping engagement with either the inner diameter of casing 11 or the outer diameter. A top drive 35 supports gripping mechanism 33 and provides the rotational force. Top drive 35 is moved upward and downward along a derrick of the drilling rig. Drilling fluid is pumped through a hose 37 that is connected to the upper end of top drive 35. Gripping mechanism 33 has a flow tube that inserts into casing string 11 and seals against the inner diameter. Gripping mechanism 33 and top drive 35 may be conventional.

FIG. 3 shows a typical "torque delivery" curve for a positive displacement drill motor such as drill motor 23. The straight line slope or curve shows that motor 23 will deliver a torque to drill bit 19 (FIG. 2) that is proportional to the pressure drop across the motor. The pressure drop across the drill motor will be the difference between the pressure at the upper end of stator 25 and the lower end of stator 25. Note that this does not imply that the pressure goes to zero at the lower end of the stator, rather the differential pressure is the difference between the pressure at the upper end and the pressure as the fluid exits drill motor 23. The fluid still has a significant flowing pressure as it exits because it must discharge through nozzles in drill bit 19 (FIG. 1) and convey cuttings back to the surface in the annulus surrounding bottom hole assembly 17 and casing string 11.

The slope of the curve in FIG. 3 is substantially straight or linear and may be described in terms of foot pounds ("ft-lbs") of torque per pounds per square inch ("psi") of differential pressure. As mentioned, the output or delivery torque of drill motor 23 depends on the pressure drop of the drilling fluid flowing through it. In example of FIG. 3, the torque output at 600 psi is about 5,000 foot pounds. At 700 psi, the torque output is a little under 6,000 foot pounds. The slope of the torque delivery curve in FIG. 3 is thus about 5,000 foot pounds over 600 psi or 8.3 foot pounds per psi.

FIG. 3 also illustrates the effect different flow rates have on the rotational speed. The flow rate curve shows, for example, that at a flow rate of 450 gallons per minute ("gpm") and a pressure drop through the motor of 200 psi (pounds per square inch), the speed would be about 125 rpm (rotations per minute). At 450 gpm and 500 psi, the speed would be a little over 100 rpm. In the example of FIG. 3, the speed of rotation of rotor 27 is indicated on the left side. Increasing the flow rate will increase the rotational speed. However, normally, the mud pumps of the drilling rig will deliver a substantially constant flow rate of drilling fluid independent of any pressure restrictions in the system up to some preset relief valve pressure.

Although the flow rate out of the mud pumps at the surface is constant, the pressure will increase if pressure restrictions occur. The consideration for flow rate will depend upon the type of mud pumps and the amount of fluid flow needed to return the cuttings to the surface. For example, if the mud pumps are set at 450 gpm, because of these considerations, the maximum torque output of the drill motor of FIG. 3 would be about 4,500 foot pounds and the differential pressure about 540 psi.

While drilling the operator will try to maintain a desired weight on bit 19 ("WOB") depending on the type of formation being drilled. The WOB is typically controlled by controlling the brakes on the blocks that suspend the drill string. As the WOB is increased, the pressure drop across drill motor 23 increases because the additional weight requires drill motor 23 to exert more torque to turn bit 19. The increased pressure drop across drill motor 23 causes the internal pressure inside casing string 11 to increase, and the increased pressure or DP within casing string 11 tends to cause the casing string 11 to elongate. Because casing string 11 is supported in tension at the surface, and the downhole end of casing 11 is supported on the bottom borehole 13, the string of casing 11 actually does not elongate. What happens is the neutral point in the casing string 11 between compression and tension moves upward, which causes the compressive force or WOB to increase. Thus an increased DP within casing string 11 will cause an increased WOB.

The large internal diameter of casing string 11 causes an exaggerated elongation of casing string 11 compared to a drill pipe string as the pressure in the casing string 11 is increased. This tendency to elongate casing string 11 provides a positive feedback loop in the motor control process. That is, an increase in WOB increases the demanded torque, which increases the internal casing pressure DP and tends to elongate casing string 11. That tendancy to elongate in turn further increases WOB. Since an increased WOB requires more torque, it can eventually cause drill motor 23 to stall when drill motor 23 is unable to provide the additional torque.

Figure 4:
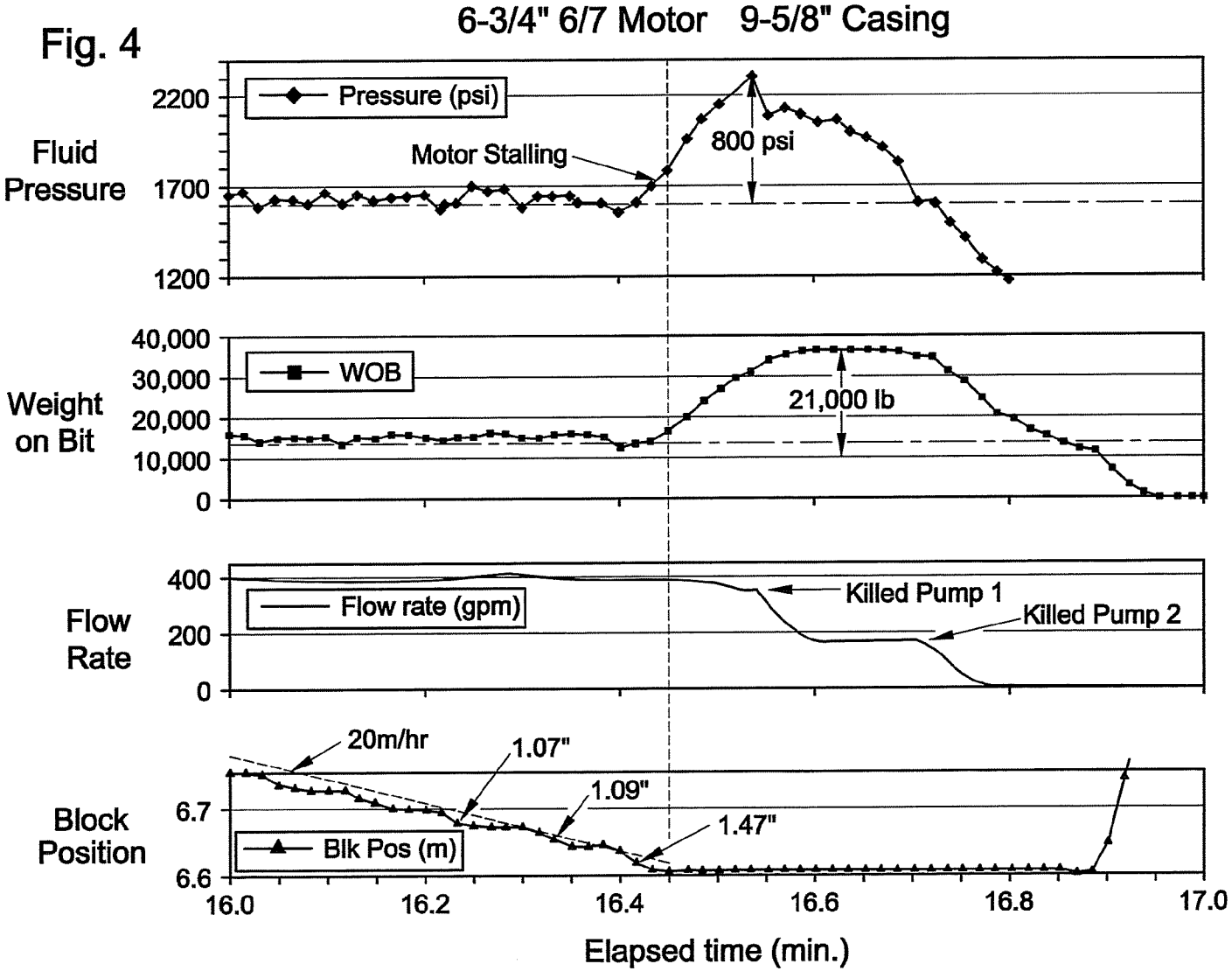
FIG. 4 is a graph illustrating a number of parameters versus time for an actual well being drilled with casing, and showing the effect that the casing pressure and weight on the bit has on drill motor stalling.

FIG. 4 shows a field example of this phenomenon. The increase in WOB that initiates the process may be an unintentional advancement of the position of the blocks by the driller, but more often, it is an unintentional advancement of the lower portion of casing string 11 caused by stick-slip movement of casing string 11 at some down hole point. The upper portion of the graph of FIG. 4 shows on the left fluid pressure between 1200 and 2200 psi versus elapsed time. The portion just lower shows the weight on the bit versus time. The next lower portion shows the drilling fluid flow rate versus time. The lowest portion of the graph of FIG. 4 shows the block elevation or position versus time.

From 16 to about 16.4 minutes, the fluid pressure, WOB and flow rates were generally constant with the fluid pressure being slightly under 1700 psi, the WOB being roughly 15,000 pounds, and the flow rate being about 400 gpm. During this time, the block position moved steadily downward along a linear slope. At around 16.45 minutes, the internal pressure at the mud pumps increased by about 800 psi. At the same time, the WOB increased by about 21,000 pounds, indicating that the drill motor was stalling. The graph shows that the operator then turned off one of the mud pumps in attempt to get the drill motor to again rotate. At 16.7 minutes, the operator turned off the second pump. During the time the drill motor was stalling, the block ceased to move downward and at 16.9, the operator picked up the blocks in order to reduce the WOB and get the drill motor to start rotating again.

FIG. 4 thus shows that an increase in the WOB causes an increase in torque, which in turn increases the DP. The increased DP tends to elongate the casing, which further increases the WOB. FIG. 4 illustrates that during casing drilling, utilizing a drill motor that avoids this motor stalling phenomenon as much as possible would be advantageous.

Figure 5:
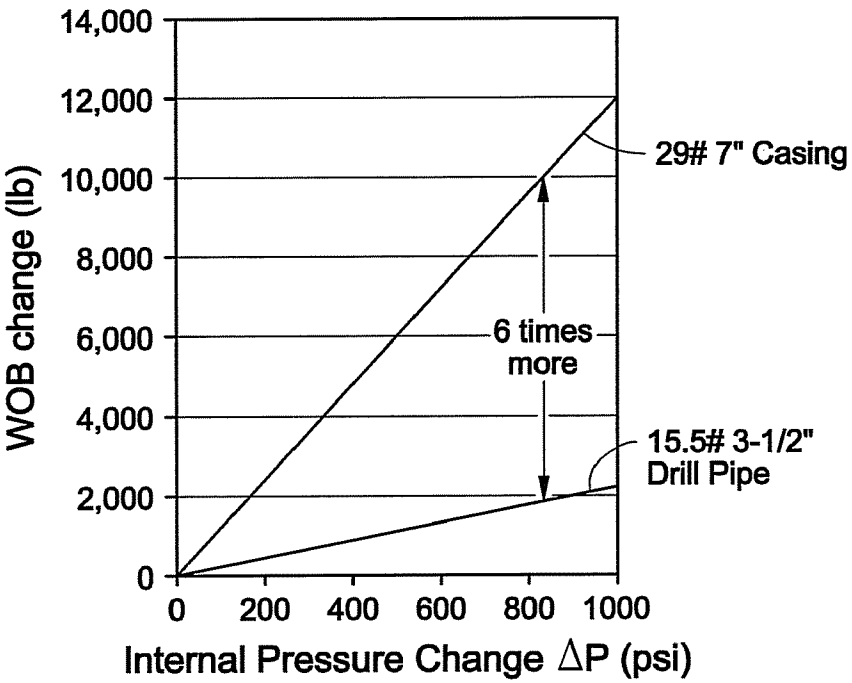
FIG. 5 is a graph of the change in weight on the bit versus the internal pressure change in the casing as calculated by the equation set forth in FIG. 5.

The amount of the increased DWOB as a function of DP can be calculated according to the equation shown in FIG. 5, which is:

$$DWOB=DP*[Ai-(2Mu*AS/(OD/10)^2-1)]$$

DP=change in casing pressure
DWOB=change in weight on bit
Ai=cross-sectional area of casing bore or inner diameter
As=cross-sectional area of the casing wall
OD=casing outside diameter
ID=casing inside diameter
Mu—Poisson's Ratio (normally 0.3)

As shown in the graph of FIG. 5, DWOB as a function of DP is linear for a tubular drill string. The slope or curve for 15.5 pound 3½ inch drill pipe shows that an increase in DP in the drill pipe of around 900 psi will increase DWOB only by about 2,000 pounds. Using the same equation for 29 pound 7 inch casing shows that an increase in DP of about 900 psi will increase DWOB by about 12,000 pounds. The difference between the two slopes is approximately six times, indicating that an increase in internal pressure in casing will increase the weight on the bit about six times as much as for drill pipe. That increase in the weight on the bit, as mentioned above, increases the torque required to rotate the drill bit, leading to stalling.

Figure 6:
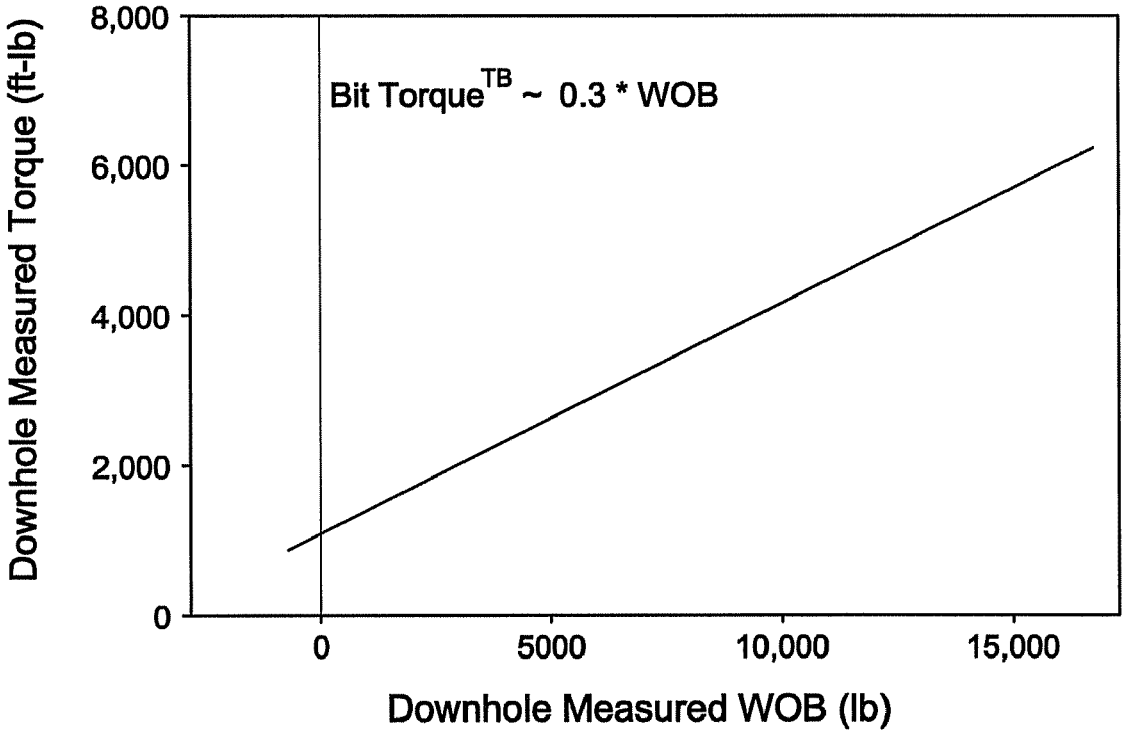
FIG. 6 is a graph illustrating a slope of bit torque versus the weight on the bit based on empirical measurements.

The torque required to rotate a bit or bit torque depends upon the type of drill bit as well as the weight on the bit. A rolling cone drill bit, for example, has bearings with cones that rotate as the bit is rotated. This type of bit demands much less torque to rotate than a fixed head bit. Fixed head or PDC bits are very commonly used and comprise a solid head bit with polycrystalline diamond cutters arranged to scrape and gouge the formation as the bit rotates. Theoretical models are available that predict a relationship between the weight on the bit and the torque for various bits. FIG. 6 illustrates a slope that was determined from empirical measurements made of a PDC bit while drilling an actual well. The data used to form the slope of FIG. 6 was collected by an instrumentation sub located directly above the bit. Although the actual data points varied above and below the sloping line shown in FIG. 6, the trend was generally linear. FIG. 6 illustrates that the torque demanded by the particular PDC bit tested was approximately equivalent to 0.3 times WOB. There will be differences depending on the particular bit size and design as well as the rock type. However, it is believed that generally, for a PDC bit, the relationship of demanded torque to WOB is approximately 0.3 times the WOB.

The relationship between the change in internal pressure of the casing DP and the applied weight on the bit DWOB is linear, according to the equation in FIG. 5 mentioned above. And since the relationship between applied WOB and bit torque is linear for a PDC bit, these two relationships can be multiplied together to provide a torque demand curve for the drilling system. That is, multiplying DWOB over DP times TDm over DWOB equals DP over TDm. The final curve of demand torque TDm as a function of DP is linear and may be expressed in foot pounds per psi. This result may be compared to the torque delivery TDe slope shown in FIG. 3. If the torque delivery slope is greater than the torque demand slope, then the particular motor under consideration may be a good choice. If the torque delivery slope is less than torque demand slope, then the particular motor is not a good choice and will result in inefficient drilling due to excessive stalling of the motor. Each time the motor stalls, the casing string has to be picked up and the motor restarted. If the situation is bad enough, the system will immediately stall the motor each time the driller tries to place the bit on the bottom of the hole.

Table 1 below provides an example of how to select a drill motor with this method:

TABLE 1

$$\text{Ratio}\frac{\text{TDE}}{\text{TDM}} = \frac{20\ \text{DP}}{15\ \text{DP}} = 1.33$$

Casing ID = 12.615 in.
Casing OD = 13.375 in.

Example of change in WOB due to pressure change
Assume DP = 300 psi
DWOB = 50 × 300 = 15.000 lb appx.

TABLE 1-continued

| | | |
|---|---|---|
| Poissons Ratio | 0.3 | |
| Internal area | 124.987 in^2 | |
| External area | 140.500 in^2 | |
| AS = | 15.513 in^2 | motor torque delivered TDe = 20 × 300 = 6,000 ft-lb |
| D WOB = | DP* [Ai-(2Mu *AS/(OD/10)$^2$ − 1)] | Bit torque due to 15,000 lb change in WOB |
| D WOB = | 50 DP | Torque demand TDm = (0.3) (15,000) = 4,500 ft-lb |
| | | motor delivery to bit demand ratio |
| | | $\text{Ratio} = \frac{6000}{4500} = 1.33$ |
| | | Ratio's greater than 1.0 are necessary and 2.0 is much better |
| Motor Torque of Candidate Motor | | |
| Motor torque slope TDE = 20 DP | | |
| | | Ratio of Bit Torque TB to WOB (0.3 typical) |
| | | Ratio = 0.3 ft. |
| | | Torque Demand TDe = (.3) (50 DP) = 15 DP |

In the example, Poissons Ratio is normally 0.3 for the type of steel employed in casing. Table 1 thus shows that for this particular string of casing, DWOB (increase in weight on bit) is proportional to 50 DP (increased in internal pressure in casing). DWOB=50 DP can be converted to TDm as a function of DP since it is known from FIG. 6 that the bit torque over the WOB is 0.3. The torque demand TDm is 0.3 times 50 DP or 15 DP. The particular candidate drill motor has a torque delivery curve, such as but not the same as that in FIG. 3, of 20 foot pounds per psi. The ratio of torque delivery TDe over torque demand TDm is 20 DP over 15 DP or 1.33. Ratios greater than 1.00 are necessary, and 1.33 might be acceptable, though 2.0 or more is preferable.

Assume for example, that the DP encountered is 300 psi as shown in Table 1 in order to operate the drill motor. The DWOB caused by this increase in pressure would be approximately 15,000 pounds. For this example, the 300 psi pressure difference was arbitrarily selected. The torque delivered by this drill motor at 300 psi would be 6,000 foot pounds. The bit torque demand TB would be 4500 foot pounds. The ratio of 6,000 foot pounds over 4500 foot pounds comes to the same ratio of 1.33.

Computations similar to those described above have been made for additional motors as set forth below in Table 2 below:

TABLE 2

| Casing Size | Recommended Motor | | | Motor Delivery TDE (ft-lb/psi) | Casing Demand* TDM | Demand Ratio |
|---|---|---|---|---|---|---|
| 7" | 4¾" | ⅞ | 3.1 | 7.8 | 3.8 | 2.0 |
| 9⅝" | 6¾" | ⅞ | 3.3 | 19.0 | 7.2 | 2.6 |
| 13⅜" | 9⅝" | ⅞ | 4.8 | 20 | 15 | 1.3 |

*Based on bit torque/WOB ratio of 0.3

Figure 7:
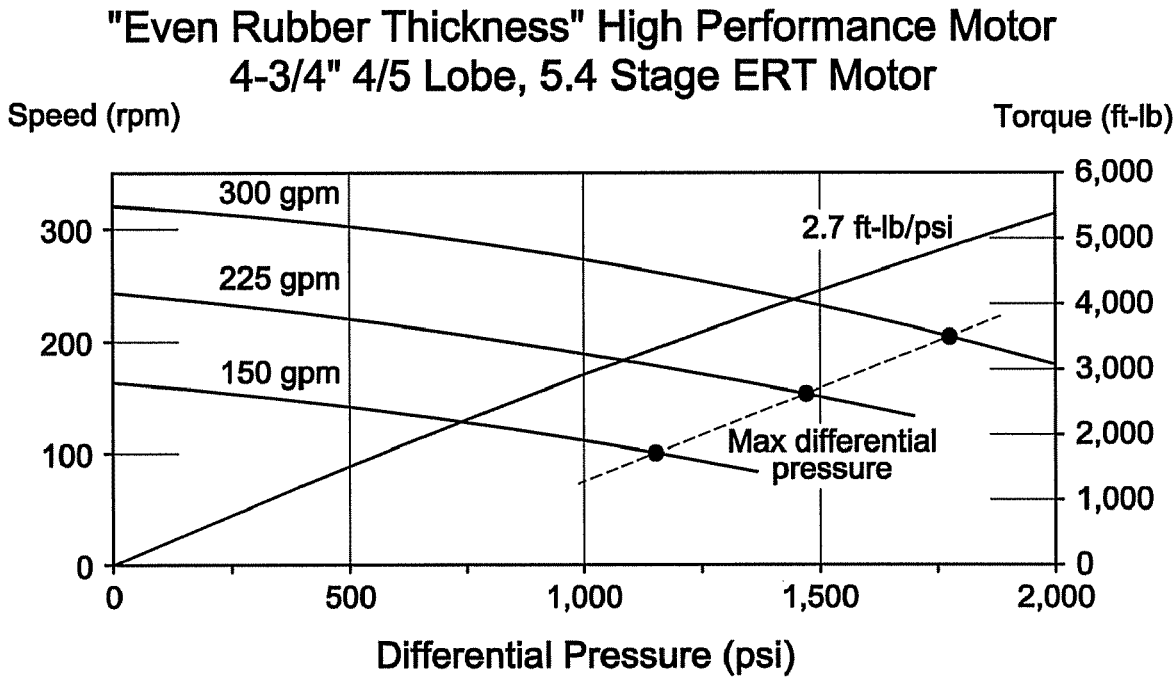
FIG. 7 is a graph of a performance curve of another drill motor.

Using the prior art process to select a motor might lead one to choose a high performance motor, an example of which is illustrated in FIG. 7. This motor may be an even rubber thickness design, such as where the stator is composed of a formed steel case coated with an even layer of rubber. This type of motor can be operated at a much higher differential pressure than motors of the type illustrated in FIG. 3 because of its improved ability to dissipate heat away from the rubber/rotor interface. Also, this design provides better support to prevent the rubber from deforming excessively under higher differential pressures. This type of motor is capable of delivering higher torque than the type illustrated in the performance curve of FIG. 3. However, the motor torque delivery slope for the high performance motor of FIG. 7 is only 2.7 foot pounds per psi. Taken from Table 2, a 7 inch casing may have a casing demand TDm of 3.8 foot pounds per psi computed as explained above. Thus, the motor illustrated by FIG. 7 is unsuitable for use in casing drilling applications with 7 inch casing although it might be an ideal motor to use when drilling with drill pipe. For example, 300 gallons per minute at a differential pressure of 500 psi produces about 5,000 foot pounds of torque per FIG. 7, while 300 gallons per minute at 500 psi of the motor in FIG. 3 produces only about 3,000 pounds of torque.

The method thus described enables one to choose a suitable drill motor for casing drilling because it takes into account the stretch or tendency of the casing to elongate in response to pressure increases.

While the invention has been shown in only one of its forms, it should be apparent to those skilled in the art that it is not so limited and is susceptible to various changes without departing from the scope of the invention.

The invention claimed is:

1. A method of selecting a drilling motor for rotating a drill bit relative to a drill string made up of well casing, comprising:

(a) determining a delivery torque (TDe) provided by a first candidate motor;

(b) based on a cross-sectional area of the casing, determining a change in weight on the drill bit (DWOB) occurring in response to a change in drilling fluid pressure (DP) within the casing, the change in weight on the drill bit (DWOB) occurring as a result of a tendency for the casing to elongate in response to an increase in the drilling fluid pressure:

(c) calculating a torque demand (TDm) for the casing based on the type of drill bit and the effect of DP on the change in weight on the bit (DWOB) determined in step (b); and (d) comparing the result of step (a) to the result of step (c) and if the result of step (a) does not exceed the result of step (c) by a selected amount, selecting a second candidate motor and repeating steps (a)-(d).

2. The method according to claim 1, wherein step (b) further comprises assuming that the casing does not actually increase in length because it is restrained from lengthening, rather a neutral point along a length of the casing representing a demarcation between tension and compression elevates, thereby causing the weight on the bit to increase.

3. The method according to claim 1, wherein step (c) further comprises determining a relationship between the amount of torque required to rotate the bit as a function of the weight on the bit.

4. The method according to claim 3, wherein the relationship determined between the amount of torque required to rotate the bit as a function of the weight on the bit is linear.

5. The method according to claim 1, wherein the difference in the weight on the bit (DWOB) in response to the difference in pressure in the casing (DP) is linear.

6. The method according to claim 1, wherein step (b) is performed according to the following equation:

$$DWOB=DP*[Ai-(2Mu*AS/(OD/10)^2-1)]$$

DP=change in casing pressure
DWOB=change in weight on bit
Ai=cross-sectional area of casing bore or inner diameter
As=cross-sectional area of the casing wall
OD=casing outside diameter
ID=casing inside diameter
Mu—Poisson's Ratio (normally 0.3).

7. A method of selecting a drilling motor for rotating a drill bit relative to a drill string made up of well casing, comprising:

(a) determining a difference in weight on the drill bit (DWOB) as a function of an increase in internal pressure (DP) in the casing by basing said determination on a cross-sectional area of the casing;
(b) based on the type of drill bit to be employed, determining a bit torque demand (TDm) as a function of the DWOB;
(c) converting the DWOB as a function of DP to TDm as a function of DP;
(d) determining a delivery torque (TDe) of a first candidate motor as a function of DP; and
(e) comparing the result of step (c) to the result of step (d), and if the result of step (d) fails to exceed the result of step (c) by a selected amount, selecting a second candidate motor and repeating steps (a)-(e).

8. The method according to claim 7, wherein the determination of step (a) is based on an increase in a neutral point between tension and compression in the casing string moving upward in response to an increase in DP, thereby increasing a compressive force on the drill bit.

9. The method according to claim 7, wherein step (b) comprises:

selecting a number for a ratio of TDm over DWOB.

10. The method according to claim 7, wherein step (c) comprises:

multiplying DWOB over DP times the ratio of TDm over DWOB.

11. The method according to claim 7, wherein:

step (c) comprises determining a constant ratio for TDm over DWOB and multiplying the constant ratio times the result of step (a) to compute TDm; and
step (d) comprises comparing the TDe to the TDm.

12. The method according to claim 7, wherein step (a) comprises making the following calculation:

$$DWOB=DP[Ai-(2muAs/(OD/ID)\text{squared}-1)];$$

wherein

Ai=area of inner diameter of casing
Mu=Poisson's Ratio
As=cross-sectional area of the casing
OD=outer diameter of the casing
ID=inner diameter of the casing.

13. A method of selecting a drilling motor for rotating a drill bit relative to a drill string made up of well casing, comprising:

(a) based on a cross-sectional area of the casing, determining a linear relationship between a change in weight on the bit (DWOB) occurring in response to an internal drilling fluid pressure change in the casing (DP);
(b) based on the type of drill bit to be employed, determining a linear ratio of bit torque demand (TDm) and DWOB;
(c) multiplying the result of step (a) times the result of step (b) to determine a linear relationship between TDm and DP;
(d) determining a delivery torque (TDe) of a first candidate motor as a function of DP; and
(e) comparing the result of step (c) to the result of step (d), and if the result of step (d) fails to exceed the result of step (c) by a selected amount, selecting a second candidate motor and repeating steps (b)-(e).

14. The method according to claim 13, wherein step (a) comprises making the following calculation:

$$DWOB=DP[Ai-(2muAs/(OD/ID)\text{squared}-1)];$$

wherein

Ai=area of inner diameter of casing
Mu=Poisson's Ratio
As=cross-sectional area of the wall of the casing
OD=outer diameter of the casing
ID=inner diameter of the casing.

15. The method according to claim 13 wherein DP comprises an estimated pressure drop of the fluid as it flows through the first or second candidate motors.

* * * * *